United States Patent [19]

Saeki et al.

[11] Patent Number: 5,035,974

[45] **Date of Patent: * Jul. 30, 1991**

[54] LIGHT-IMAGE FORMING MATERIAL

[75] Inventors: Keiso Saeki; Toshiaki Endo, both of Shizuoka, Japan

[73] Assignee: Fuji Photo Film Co., Ltd., Kanagawa, Japan

[ * ] Notice: The portion of the term of this patent subsequent to Oct. 9, 2007 has been disclaimed.

[21] Appl. No.: 366,392

[22] Filed: Jun. 15, 1989

[30] Foreign Application Priority Data

Jun. 16, 1988 [JP] Japan ..... 63-148907
Jun. 16, 1988 [JP] Japan ..... 63-148908

[51] Int. Cl.[5] ..... G03C 1/72

[52] U.S. Cl. ..... 430/138; 430/523; 430/531; 430/539

[58] Field of Search ..... 430/138, 523, 531, 539

[56] References Cited

U.S. PATENT DOCUMENTS 4,006,023 2/1977 McLaughlin et al. ..... 430/292
4,190,449 2/1980 Naoi et al. ..... 430/539
4,247,618 1/1981 Dessauer et al. ..... 430/342
4,399,213 8/1983 Watanabe et al. ..... 430/539
4,409,322 10/1983 Ezaki et al. ..... 430/531
4,450,230 5/1984 Delfino et al. ..... 430/539
4,460,680 7/1984 Ogawa et al. ..... 430/539
4,499,179 2/1985 Ota et al. ..... 430/523
4,868,087 9/1989 Yamamoto ..... 430/138
4,871,641 10/1989 Kakimi ..... 430/138
4,885,224 12/1989 Yamamoto et al. ..... 430/203

FOREIGN PATENT DOCUMENTS 1009646 1/1986 Japan .

*Primary Examiner*—Hoa Van Le
*Attorney, Agent, or Firm*—Sughrue, Mion, Zinn, Macpeak & Seas

[57] ABSTRACT

A light-image forming material comprising a support having provided thereon a light-image forming layer comprising microcapsules containing an oxidative-developable leuco dye and a photo-oxidizing agent, and a reducing agent as essential ingredients, wherein the material also includes a covering layer or intermediate layer containing a film-forming high-molecular binder and/or an inorganic or organic pigment.

10 Claims, No Drawings

LIGHT-IMAGE FORMING MATERIAL

FIELD OF THE INVENTION

This invention relates to a light-image forming material and more particularly to a heat fixable leuco dye light-image forming material. Still more particularly, it pertains to a light image forming material which is excellent in image-reproducibility and shelf stability (fresh storage property) before light recording as well as in image-stability. Further, background yellowing hardly occurs and the material scarcely stains heat fixing rolls.

BACKGROUND OF THE INVENTION

Light-image forming materials which can be used in the field of proof paper, printing out paper, overlay films, etc., have been conventionally applied to many photographic fields as free radical photographic materials whose sensitive areas are visualized by image exposure.

Methods in which various leuco dyes are developed to the corresponding colored dyes by radical oxidation by using photo-oxidizing agents, are particularly effective for these uses. However, these dyes are sensitive to light so that even after a dye image is formed by exposure, color is also generally formed, upon exposure to To retain an image after once the image is formed, unirradiated areas during exposure must be kept undeveloped. For example, it is known to preserve an original image by applying a solution of a reducing agent such as a free radical trapping substance to a material having an image formed thereon, for example, by spraying said solution on said material or impregnating said material with said solution. However, there is a serious problem caused by this wet process in that its working and operation become complicated. In the specification of JP-A-47 12879 (the term "JP-A" as used herein means an "unexamined published Japanese patent application"), there has been proposed a process in which an image is formed by ultraviolet light and fixing is carried out by activating a photo-reducible substance with visible light. However, this process has problems in that an apparatus must be exclusively used during the operation, because light must be used twice, and in that a spectral filter must be replaced with another one, because two different lights must be used. In the specification of JP-B-43-29407 (the term "JP-B" as used herein means an "examined Japanese patent publication"), there has been proposed a process in which heat fixing is carried out after the image exposure either by incorporating a reducing heat fixing agent in a light-sensitive layer, or by coating the surface of the light-sensitive layer with the heat fixing agent. However, this process has a problem in that lowering in sensitivity is caused with the passage of time, because light-sensitive components (leuco dye and photo-oxidizing agent) exist in close vicinity to the fixing agent Further, since the above-mentioned light-image forming material is coated on the surface of a support by using organic solvents, the manufacturing plant thereof must be provided with an explosion-proof provision. Therefore, this process has disadvantages in safety and cost.

In order to solve these problems, there has been proposed a light image forming material in which the leuco dye and the photo-oxidizing agent are enclosed in microcapsules and the reducing agent is allowed to exist outside the microcapsules (Japanese Patent Application No. 62-259111 (corresponding to U.S. Pat. application Ser. No. 07/257,580 filed on Oct. 14, 1988)). However, such light-image forming materials have such problems that image-reproducibility, fresh storage property and image-preservability are still insufficient, heat fixing rollers are stained during heat fixing and background parts after heat fixing turn yellow with the passage of time.

SUMMARY OF THE INVENTION

Accordingly, an object of the present invention is to provide a light-image forming material which can be heat fixed and is excellent in image-reproducibility, fresh storage property and image preservability.

Another object of the present invention is to provide a light-image forming material which prevents heat fixing rollers from being stained and also prevents background areas from being yellowed after fixing.

The above described objects of the present invention have been achieved by providing a light-image forming material comprising a support having provided thereon a light-image forming layer comprising microcapsules containing an oxidative color developable leuco dye and a photo-oxidizing agent, and a reducing agent outside the microcapsule, and a covering or intermediate layer containing a film-forming high-molecular binder and/or an inorganic or organic pigment. The layer containing a film-forming high-molecular binder and/or an inorganic or organic pigment is provided as a covering layer on the surface of the light-image forming layer and/or is provided as an intermediate layer between the light-image forming layer and the support.

DETAILED DESCRIPTION OF THE INVENTION

The film-forming high-molecular binders which can be used in the present invention include water-soluble high-molecular binders and water-insoluble binders. These binders may be used either alone or as a mixture of two or more of them.

Examples of the water-soluble high-molecular binders include methyl cellulose, carboxymethyl cellulose, hydroxyethyl cellulose, starches, gelatin, gum arabic, casein, hydrolyzates of styrene-maleic anhydride copolymers, hydrolyzates of ethylene-maleic anhydride copolymers, hydrolyzates of isobutylene-maleic anhydride copolymers, hydrolyzates of vinyl acetate-maleic anhydride copolymers, hydrolyzates of vinyl methyl ether-maleic anhydride copolymers, polyvinyl alcohol, carboxy-modified polyvinyl alcohol, silicon-modified polyvinyl alcohol, polyacrylamide, polyvinyl pyrrolidone and sodium alginate.

Examples of the water-insoluble binders include synthetic rubber latexes and synthetic resin emulsions such as styrene-butadiene rubber latex, acrylonitrilebutadiene rubber latex, methyl acrylate-butadiene rubber latex, polyvinyl acetate emulsion, polyacrylic acid emulsion, polyester emulsion and polyurethane emulsion.

Examples of the inorganic and organic pigments which can be used in the present invention include kaolin, calcined kaolin, talc, calcium carbonate, amorphous silica, barium sulfate, aluminum hydroxide, fine powder of urea-formalin resin, fine powder of polyethylene resin and fine powder of polystyrene resin. These pigments may be used either alone or as a mixture of two or more of them.

Pigments which can be used in the present invention preferably include pigments having an apparent specific gravity of not higher than 0.7 g/cm$^3$. Pigments having a particle size of from 0.5 to 5 μm are more preferred. Pigments having an oil absorption of not lower than 40 cc/100 g according to JIS-K5101 are still more preferred, and having a whiteness degree of not lower than 5% are particularly preferred.

If desired, the layer containing a film forming high molecular binder and/or an inorganic or organic pigment may contain wax such as polyethylene wax, carnauba wax, paraffin wax, microcrystalline wax or fatty acid amide; metallic soap such as zinc stearate or calcium stearate; and starch particles.

The ratio of the binder to the pigment in the covering layer or intermediate layer of the present invention is preferably in the range of from 1:0 to 1:20.

In the covering layer of the present invention, it is particularly preferred that the ratio of the binder to the pigment is in the range of from 1:1 to 1:5 by weight. The total coating weight thereof is in the range of 0.1 to 5 g/m$^2$, preferably 0.5 to 3 g/m$^2$ (as a solid). When the coating weight is less than the lower limit defined above, effect is low, while when the coating weight is more than the upper limit, sensitivity to color development by light or heat fixing is greatly lowered.

In the intermediate layer of the present invention, it is particularly preferred that the ratio of the binder to the pigment is in the range of from 1:3 to 1:10 by weight. The total coating weight thereof is in 1 to 15 g/m$^2$, preferably from 3 to 10 g/m$^2$ (as a solid). When the coating weight is less than the lower limit defined above, effect is low, while when the coating weight is more than the upper limit, aggregates are liable to be formed and further there is disadvantageous in cost.

The apparent specific gravity was measured according to Becher Rosenmuller's method (see, *Saishin Ganryo Binran* (Newest Pigment Handbook), published by Seibundo Shinkosha, page 81). The whiteness degree was measured according to Tappi standard method T-452.

The preferred microcapsule of the present invention is one that separates substances inside the microcapsule from those outside the microcapsule by an isolating action of the shell of the microcapsule at room temperature to thereby prevent the substances inside and outside the capsule from being brought into contact with each other and the permeability of the shell material is increased, only when heated to a specific temperature or higher. The permeation initiating temperature can be optionally controlled by properly choosing the shell and core materials of the microcapsule, and additives. The permeation-initiating temperature corresponds to the glass transition temperature of the shell of the microcapsule.

The glass transition temperature inherent to the shell of the microcapsule can be controlled by changing the kinds of microcapsule shell forming materials. Examples of the shell materials useful in the present invention include polyurethane, polyurea, polyamide, polyester and polycarbonate. Among them, polyurethane and polyurea are particularly preferred.

The microcapsule of the present invention can be prepared by emulsifying a core material containing light-image forming materials such as leuco dye and photo-oxidizing agent and then, forming a shell composed of a high molecular material around the emulsion oil droplet, as described, for example, in U.S. Pat. Nos. 3,726,804 and 3,796,696. In the case of the preparation, the reactant which forms the shell is added to the interior of the oil droplet and/or the exterior of the oil droplet.

High-boiling oils can be used as organic solvents for dissolving the light-image forming substances. Examples of the high-boiling oils include phosphoric esters, phthalic esters, acrylic esters, methacrylic esters, other carboxylic acid esters, fatty acid amides, alkylated biphenyls, alkylated terphenyls, alkylated naphthalene, diarylethanes and chlorinated paraffins.

Low-boiling co-solvents may be added to the above-described organic solvents. Examples of the co-solvents include ethyl acetate, isopropyl acetate, butyl acetate, methylene chloride and cyclohexanone.

Protective colloid or surfactant can be added to the water phase to stably prepare the emulsified oil droplet.

The size of the microcapsule is preferably not larger than 20 μm, more preferably not larger than 4 μm in terms of volume average from the viewpoints of improving the resolution of image and its handling property.

The leuco dye constituting one component of the light-image forming material of the present invention is a reduction type of leuco dye having one or two hydrogen atoms and is developed by the removal of the hydrogen atoms or the addition of additional electron(s) to form a dye. Since such leuco dyes are substantially colorless or have a pale color, a pattern is formed when they are developed by oxidation. This oxidation is caused by at least one photo-oxidizing agent. The photo-oxidizing agent is activated by the irradiation of light and thereby reacted with the leuco dye to form a colored image.

Examples of the leuco dyes which can be easily developed by the above-described mechanism include those described, for example, in U.S. Pat. No. 3,445,234. The leuco dyes described there are the following types of compounds.

(1) Aminotriarylmethane
(2) Aminoxanthene
(3) Aminothioxanthene
(4) Amino-9,10-dihydroacridine
(5) Aminophenoxazine
(6) Aminophenothiazine
(7) Aminodihydrophenazine
(8) Aminodiphenylmethane
(9) Leuco indamine
(10) Aminohydrocinnamic acid (cyanoethane, leucomethine)
(11) Hydrazine
(12) Leuco indigoid dyes
(13) Amino-2,3-dihydroanthraquinone
(14) Tetrahalo-p,p'-biphenol
(15) 2-(p-Hydroxyphenyl)-4,5-diphenylimidazole
(16) Phenetylaniline Among these leuco dyes, the compounds of the type (1) to (9) form matrix dyes by losing one hydrogen atom. The compounds of the type (10) to (16) form matrix dyes by losing two hydrogen atoms.

Specific examples of the dyes include Leuco Crystal Violet, tris(4-diethylamino o-tolyl)methane, bis(4-diethylamino-o-tolyl)phenylmethane, bis(4-diethylamino-o-tolyl)-thienyl-2-methane, bis(2-chloro-4-diethylaminophenyl)phenylmethane, 2-(2-chlorophenyl-)amino-6-N,N-dibutylamino-9-(2-methoxycarbonyl)-phenylxanthene, 2-N,N-dibenzylamino-6 N,N-diethylamino 9-(2-methoxycarbonyl)phenylxanthene, benzo[a]-6-N,N diethylamino 9-(2-methoxycarbonyl)-phenylxanthene, 2-(2-chlorophenyl) amino-6-N,N-dibutylamino-9-(2-methylphenylcarboxyamido)-phenylxanthene, 3,6-dimethoxy-9-(2-methoxycarbonyl)phenylxanthene, 3,6-diethoxyethyl-9 (2-methoxycarbonyl)phenylxanthene, benzoyl leuco Methylene Blue and 3,7-bisdiethylaminophenoxazine.

Preferred photo-oxidizing agents which can be used in the light-image forming material of the present invention are ordinarily inactive, but form chemical species which can oxidize the leuco dyes to developable type when exposed to actinic rays such as visible light, ultraviolet light, infrared rays and X rays.

Typical examples of the photo-oxidizing agents include lophine dimer compounds such as 2,4,5-triarylimidazole dimers as described in JP-B-62-39728 and JP B-63-2099 (corresponding to U.S. Pat. Nos. 4,252,887 and 4,311,783); azide compounds such as 2-azidobenzoxazole, benzoyl azide and 2-azidobenzimidazole as described in U.S. Pat. No. 3,282,693; pyridinium compounds such as 3'-ethyl-1-methoxy-2-pyridothiacyanin perchlorate and 1-methoxy-2-methylpyridinium p-toluenesulfonate; organic halogen compounds such as N-bromosuccinimide, tribromomethylphenyl sulfone, 2 trichloromethyl-5-(p-butoxy-styryl)-1,3,4-oxadiazole and 2,6-di-trichloromethyl-4-(p-methoxyphenyl)-triazine as described in U.S. Pat. No. 3,615,568; and azide polymers as described in *Shunki Kenkyu Happvokai Koen Yoshi,* ed. Nippon Shashin Gakkai, page 55 (1968). Among them, the lophine dimer compounds and the organic halogen compounds are preferred. The combination use of the lophine dimer compounds with the organic halogen compounds are still more preferred from the viewpoint of enhancing sensitivity.

In the preparation of the light-image forming material of the present invention, the leuco dye is mixed with the photo-oxidizing agent in a molar ratio of preferably from 10:1 to 1:10, more preferably from 2:1 to 1:2.

A stable image is obtained by conducting a heat treatment after the formation of an image by exposing the light-image forming material of the present invention. Namely, the fixing mechanism of the light-image forming material of the present invention is such that the photo-oxidizing agent is brought into contact with the reducing agent through the shell of the microcapsule by heating so that even when the photo-oxidizing agent is activated later, the oxidizing agent is deactivated by the action of the reducing agent.

The reducing agent serves as a free radical-trapping substance which traps the free radical of the activated photo-oxidizing agent.

Examples of the reducing agents include aminophenol compounds and hydroquinone compounds, wherein a hydroxyl group is positioned on the benzene ring and at least another hydroxyl group or amino group is attached to the another position of the benzene ring, as described in U.S. Pat. No. 3,042,515; and cyclic phenylhydrazide compounds, guanidine derivatives, alkylenediamine derivatives and hydroxyamine derivatives as described in JP-B-62-39728. These reducing agents may be used either alone or in a combination of two or more of them. Any reducing agents capable of reacting with the oxidizing agents can be used without being limited to the above-described compounds.

In the preparation of the light-image forming material of the present invention, the reducing agent is dispersed as a solid by using a sand mill, or is dissolved in oil and then dispersed as an emulsion.

The reducing agent is used in an amount of 1 to 100 times by mol, preferably 5 to 20 times by mol of the mol amount of the photo-oxidizing agent.

Though the fixing of the image in the present invention can be effectively performed by bringing the photo oxidizing agent into contact with the reducing agent through the shell of the microcapsule by heating as described above, a synergistic effect can be obtained by applying heat and pressure simultaneously. The temperature of the heat-fixing process of the present invention is in the range of preferably from 90° C. to 130° C. The pressure range of which can be applied simultaneously with the heat-fixing process can be selected in accordance with the property of the microcapsule by one skilled in the art. It is preferred to use a melting point depressant such as p-benzyloxyphenol or p-toluenesulfonamide together with said reducing agent, because low-temperature fixing becomes possible.

If desired, a conventional sensitizing agent or antioxidant may be contained in the microcapsule.

The light-image forming material having the covering layer according to the present invention can be prepared by coating the support with a dispersion of the reducing agent and the microcapsules containing the leuco dye and the photo-oxidizing agent and then providing a covering layer comprising a film-forming high-molecular binder and/or a pigment.

The light-image forming material having the intermediate layer according to the present invention can be prepared by previously providing an intermediate layer comprising a film-forming high-molecular binder and/or a pigment on the support and then coating a dispersion of the reducing agent and the microcapsules containing the leuco dye and the photo-oxidizing agent thereon. Alternatively, two layers are simultaneously coated on the support.

A binder may be added to aforesaid dispersion of microcapsules containing the leuco dye and the photo-oxidizing agent, and the reducing agent. The coating weight of the dispersion is preferably 3 to 30 g/m$^2$, particularly preferably 5 to 20 g/m$^2$ on a solid basis.

Materials suitable for use as the support of the present invention are papers such as tissue paper or thick cardboard, regenerated cellulose, cellulose acetate, cellulose nitrate, polyethylene terephthalate, poly ethylene, polyvinyl acetate, polymethyl methacrylate and polyvinyl chloride.

The aforesaid dispersion, and the film-forming high-molecular binder and/or the inorganic or organic pigment of the present invention can be coated on a support or a light-image forming layer by the methods such as air knife coating method, curtain coating method, slide coating method, roller coating method, dip coating method, wire bar coating method, blade coating method, gravure coating method, spin coating method, extrusion coating method, doctor coating method or slide coating method. However, the coating methods to be applied in this invention are not limited to the above methods.

The construction and production of the light-image forming material according to the present invention are further described, for example, in U.S. application Ser. No. 07/257,580 filed on Oct.14, 1988 now U.S. Pat. No. 4,962,009.

Any convenient light source can be used for the activation of the photo-oxidizing agent or for the formation of the image of the leuco dye. Examples of conventional light sources include fluorescent lamp, mercury lamp, metal halide lamp, xenon lamp and tungsten lamp.

The light image forming material of the present invention is excellent in storage stability before recording and image stability and can be used as a light-image forming composition which prevents heat fixing rollers from being stained and also prevents background part from being yellowed after heat fixing.

The present invention is now illustrated in greater detail by reference to the following examples which, however, are not to be construed as limiting the present invention in any way. Unless otherwise specified, all parts, percents and ratios are by weight.

EXAMPLE 1

Preparation of the microcapsule dispersion 3 parts of Leuco Crystal Violet, 3 parts of 2,2'-bis(o-chlorophenyl)-4,4',5,5'-tetraphenylbiimidazole, 0.6 parts of tribromomethylphenyl sulfone, 0.4 part of 2,5 di-tert-octyl-hydroquinone and 24 parts of a 75 % by weight ethyl acetate solution of a xylylene diisocyanate/trimethylolpropane (3:1) addition product were added to a mixed solution of 22 parts of methylene chloride and 24 parts of tricresyl phosphate and dissolved therein. The resulting solution was added to 63 parts of a 8% by weight aqueous solution of polyvinyl alcohol, and then, emulsified and dispersed at 20° C. to obtain an emulsion having a mean grain size of 1 μm. 100 parts of water was added to the resulting emulsion, and the mixture was continuously stirred at 40° C. for 3 hours. The mixture was then cooled to room temperature and filtered to obtain a microcapsule dispersion.

Preparation of the phenidone A dispersion 30 parts of 1-phenylpyrazolidine-3-one (phenidone A) was added to 150 parts of a 4% by weight aqueous solution of polyvinyl alcohol and dispersed in a transverse sand mill to obtain a phenidone A dispersion having an average particle size of 1 μm.

9 parts of aforesaid microcapsule dispersion was mixed with 6 parts of the phenidone A dispersion. The resulting mixture was coated to fine paper (a basis weight of 76 g/m2) by means of a coating rod in such an amount as to give a coating weight of 10 g/m$^2$ on a solid basis. The coated paper obtained was dried at 50° C.

The surface of the resulting light-sensitive color-forming layer was coated with a coating solution by means of a coating rod as described below for the covering layer in such an amount as to give a coating weight of 2.5 g/m$^2$, and then dried and subjected to calendering to obtaining a light-image forming material having the covering layer according to the present invention.

Preparation of the coating solution for the covering layer

| | |
|---|---|
| Aqueous solution of 10% silicon-modified polyvinyl alcohol (R2105, trade name, produced by Curaray Co., Ltd.) | 70 parts |
| Dispersion of 50% calcium carbonate | 20 parts |
| Dispersion of 21% paraffin wax | 2.5 parts |
| Dispersion of 30% zinc stearate | 1.5 parts |

These ingredients were mixed to prepare the coating solution for the covering layer.

EXAMPLE 2

The procedure of Example 1 was repeated except that the coating solution for the covering layer was changed to the following formulation. There was obtained a light-image forming material having the covering layer.

Preparation of the coating solution for the covering layer

| | |
|---|---|
| Aqueous solution of 5% carboxy-modified polyvinyl alcohol | 50 parts |
| 20% calcium-treated amorphous silica | 20 parts |
| Dispersion of 30% zinc stearate | 1.5 parts |
| Dispersion of 20% stearamide | 2.5 parts |

These ingredients were mixed to prepare the coating solution for the covering layer.

COMPARATIVE EXAMPLE 1

The procedure of Example 1 was repeated except that the covering layer was omitted to obtained a light-image forming material.

The light image forming materials obtained in Examples 1 and 2 and Comparative Example 1 were tested in the following manners. The results are shown in Table 1.

(1) Image density

Fresh samples were irradiated with light through the original of line drawings by using jet light (ultrahigh pressure mercury lamp, manufactured by Oak k.k.). The image density of the exposed area was measured with (2) Staining of heat fixing roller 50 sheets of the above sample (A4 size) after the formation of the image were passed through rollers heated to 120° C. at a rate of 450 mm/min. The staining of the rollers was visually evaluated.

(3) Yellowing of background

After the completion of the above heat fixing, the sample was continuously irradiated by a fluorescent lamp with 200-lux for 10 days. The yellow density of the background was measured with Macbeth reflection density meter. The measured density was compared with the yellow density of the background before irradiation.

It is apparent that the light-image forming materials of Examples 1 and 2 have a image density similar to that of the light-image forming material of Comparative Example 1 having no covering layer, but do not stain the heat fixing rollers and scarcely cause the yellowing of the background after heat fixing.

TABLE 1

| | Example 1 | Example 2 | Comparative Example 1 |
|---|---|---|---|
| Image Density | 1.23 | 1.22 | 1.24 |
| Staining of heat fixing roller | not stained | not stained | stained |
| Yellow density of background | | | |
| Before irradiation | 0.070 | 0.069 | 0.068 |
| After irradiation | 0.094 | 0.091 | 0.241 |

EXAMPLE 3

The mixture of 9 parts of microcapsule dispersion obtained in Example 1 and 6 parts of phenidone A dispersion obtained in Example 1 was coated to undercoated base paper (prepared as described below) by means of a coating rod in such an amount as to give a coating weight of 10 g/m2 on a solid basis, and then dried at 50° C. to obtaining a light-image forming material having the intermediate layer according to the present invention.

Preparation of the undercoated base paper 80 parts of calcined kaolin as a pigment was dispersed in 160 parts of a 0.5% aqueous solution of sodium hexametaphosphate by using a homogenizer. 10 parts of 48% styrene-butadiene latex was added to 60 parts of the resulting dispersion to prepare a coating solution for the intermediate layer. The resulting mixture was coated to fine paper (a basis weight of 76 g/m2) by means of air knife coating method in such an amount as to give a coating weight of 6 g/m$^2$ on a solid basis. The coated paper was dried to obtain the undercoated base paper.

EXAMPLE 4

The procedure of Example 3 was repeated except that precipitated calcium carbonate was used in place of calcined kaolin in the coating solution for the intermediate layer to prepare a light-image forming material.

EXAMPLE 5

The procedure of Example 3 was repeated except that 40 parts of an aqueous solution of 8% polyvinyl alcohol was used in place of 10 parts of 48% styrenebutadiene latex in the coating solution for the intermediate layer to prepare a light-image forming material.

COMPARATIVE EXAMPLE 2

The procedure of Example 3 was repeated except that the intermediate layer was omitted to prepare a light-image forming material.

The light-image forming materials obtained in Examples 3 to 5 and Comparative Example 2 were tested in the following manners. The results are shown in Table 2.

(1) Image density

Fresh samples were irradiated with light through the original of line drawings by using jet light (ultrahigh pressure mercury lamp, manufactured by Oak k.k.). The image density of the exposed area was measured with Macbeth reflection densitometer.

(2) Yellowing of background

After the completion of the above image formation, heat fixing was carried out by passing the sample through rollers heated to 120° C. at a rate of 450 mm/min. The sample was continuously irradiated by a fluorescent lamp with 200 lux for 10 days. Then, yellow density of the background was measured with Macbeth reflection densitometer. The measured density was compared with the yellow density of the background before irradiation with the fluorescent lamp.

(3) Image reproducibility

Light irradiation was conducted through the original having the ratio of halftone dots stepwise changed within the range of from 1 to 95%. Thereafter, heat fixing was carried out to obtain an image in which the area of the halftone dots (unexposed area) fell out. The image was observed with a microscope, and evaluated as to the ratio of the halftone dots at which the breakage of the halftone dots was not caused and good state was kept. A smaller numerical value means better image reproducibility.

TABLE 2

| | Image density | Image reproducibility | Yellowing of Background |
|---|---|---|---|
| Example 3 | 1.26 | 4% | 0.110 (0.063)* |
| Example 4 | 1.27 | 5% | 0.109 (0.062)* |
| Example 5 | 1.26 | 5% | 0.112 (0.065)* |
| Comparative Example 2 | 1.24 | 30% | 0.241 (0.068)* |

*before irradiation

It is apparent that the light-image forming materials of Examples 3, 4 and 5 according to the present invention have image density similar to that of the light-image forming material of Comparative Example 2 having no intermediate layer, but are excellent in image reproducibility and scarcely cause the yellowing of the background after heat fixing.

While the invention has been described in detail and with reference to specific embodiments thereof, it will be apparent to one skilled in the art that various changes and modifications can be made therein without departing from the spirit and scope thereof.

We claim:

1. A light-image forming material comprising a support having provided thereon a light-image forming layer consisting essentially of microcapsules containing an oxidative-developable leuco dye and a photo-oxidizing agent, and a reducing agent outside said microcapsules, and a covering layer or an intermediate layer containing a film-forming high-molecular binder and/or an inorganic or organic pigment, and wherein the shell of said microcapsules is comprises of a substance which separates the substances inside the microcapsule from those outside the microcapsule at room temperature and wherein the permeability of the shell material is increased only when heated to a specific temperature or higher.

2. A light image forming material as in claim 1, wherein said covering layer containing a film-forming high-molecular binder and/or an inorganic or organic pigment is provided on said light-image forming layer.

3. A light-image forming material as in claim 1, wherein said intermediate layer containing a film-forming high-molecular binder and/or an inorganic or organic pigment is provided between said support and said light-image forming layer.

4. A light-image forming material as in claim 1, wherein said inorganic or organic pigment is an inorganic or organic pigment having an apparent specific gravity of not higher than 0.7 g/cm3.

5. A light image forming material as in claim 2, wherein said covering layer contains said high-molecular binder and pigment in a ratio of binder to pigment in the range of from 1:0 to 1:20 by weight and the total coating weight thereof is in the range of from 0.1 to 5 $g/m^2$.

6. A light-image forming material as in claim 5, wherein the ratio of binder to pigment is in the range of from 1:1 to 1:5 by weight and the total coating weight thereof is in the range of from 0.5 to 3 g/m2.

7. A light-image forming material as in claim 3, wherein the ratio of the binder to the pigment is in the range of from 1:0 to 1:20 by weight and the total coating weight thereof is in the range of from 1 to 15 g/m2.

8. A light-image forming material as in claim 7, wherein the ratio of the binder to the pigment is in the range of from 1:3 to 1:10 and the total coating weight thereof is in the range of from 3 to 10 $g/m^2$.

9. A light image forming material as in claim 1, wherein the pigment has a whiteness degree not lower than 85%.

10. A light-image forming material as in claim 1, wherein the binder is a water soluble high-molecular binder or a water-insoluble high-molecular binder.

* * * * *